US005631121A

United States Patent [19]

Ridgway et al.

[11] Patent Number: 5,631,121

[45] Date of Patent: May 20, 1997

[54] PHOTOGRAPHIC PROCESSING

[75] Inventors: Michael Ridgway, Aldbury; John R. Fyson, Hackney, both of England

[73] Assignee: Eastman Kodak Company, Rochester, N.Y.

[21] Appl. No.: 694,225

[22] Filed: Aug. 8, 1996

Related U.S. Application Data

[63] Continuation of Ser. No. 518,731, Aug. 24, 1995, abandoned.

[30] Foreign Application Priority Data

Aug. 27, 1994 [GB] United Kingdom ..... 9417319

[51] Int. Cl.[6] ..... G03C 5/29

[52] U.S. Cl. ..... 430/423; 430/422

[58] Field of Search ..... 430/422, 423

[56] References Cited

U.S. PATENT DOCUMENTS

| | | | |
|---|---|---|---|
| 2,168,971 | 8/1939 | Capstaff . | |
| 4,780,737 | 10/1988 | Kobayashi et al. | 354/299 |
| 5,223,883 | 6/1993 | Suzuki | 354/320 |
| 5,462,851 | 10/1995 | Kato et al. | 430/584 |

FOREIGN PATENT DOCUMENTS

| | | |
|---|---|---|
| 0595236A1 | 10/1992 | European Pat. Off. . |
| 0528389A1 | 2/1993 | European Pat. Off. . |
| 0562401 | 9/1993 | European Pat. Off. . |
| 0532558 | 9/1994 | European Pat. Off. . |
| 0515454 | 3/1995 | European Pat. Off. . |
| 92/07302 | 4/1992 | WIPO . |
| 93/00612 | 1/1993 | WIPO . |
| 93/11464 | 6/1993 | WIPO . |

*Primary Examiner*—Hoa Van Le
*Attorney, Agent, or Firm*—Frank Pincelli

[57] ABSTRACT

It is important to control the temperature during the development stage of a photographic process in order to maximize the efficiency thereof. This is a particular problem when photographic materials are processed in high throughput processors which operate with reduced volume chemistry as these material have a tendency to cool the developer solution if not at the correct temperature. Described herein is a method for improving the temperature stability of the material to be processed by heating it before processing. The material is passed through a conditioning chamber where it is heated to the desired processing temperature prior to entering the development stage of a processor.

7 Claims, 3 Drawing Sheets

PHOTOGRAPHIC PROCESSING

This is a Continuation of application Ser. No. 08/518,731, filed Aug. 24, 1995 now abandoned.

FIELD OF THE INVENTION

The present invention relates to improvements in or relating to photographic processing and is more particularly concerned with high capacity processors which utilize low volumes of processing solutions.

BACKGROUND OF THE INVENTION

It is well known to process photographic materials in web and sheet form by passing the material through a photographic processor which comprises a plurality of processing stages, for example, developer, bleach, bleach-fix, wash, and stabilizer stages, etc. The material is processed in each stage by the processing solutions retained in that particular part of the processor. In such apparatus, the material being processed is substantially immersed in the solution in each of the processing stages. As a result, the volumes of processing solutions used tend to be large, often at least 40 or 50 liters.

It is also known to process photographic materials using low volumes of solution, typically less than 1 liter and preferably around 100 ml. Such arrangements are described in published European Patent Applications EP-A-0 515 454, EP-A-0 532 558, EP-A-0 546 136, EP-A-0 553 172, EP-A-0 614 545 and others. In processing apparatus in which low volumes of processing solutions are utilized, unstable processing chemistry can be employed, for example, redox amplification (RX) chemistry.

EP-A-0 562 401 discloses an arrangement for a photographic processor in which the volumes of processing solution utilized are reduced. The processor is of conventional size, that is, having large tank volumes, but in which lower volumes of processing solutions are utilized. The processing bath for each processing stage comprises a plurality of processing tanks. Each processing bath contains upper and lower guide rollers over which the photographic material to be processed is transported, each of the lower rollers being located in a respective one of the processing tanks. The material is alternately dipped into a processing tank and processing solution retained therein in the bath and not dipped so that the time for which the material is dipped in processing solution is not more than 50% of the total time in that particular processing bath.

PROBLEM TO BE SOLVED BY THE INVENTION

Due to the large throughput of photographic material through processors which operate with low volumes of processing solution, there is a problem with temperature instability of the material being processed, particularly photographic paper.

The temperature of the paper significantly exacerbates the problem of controlling the temperature of the paper and chemistry during the development stage. This is because the photographic paper tends to cool the developer solution (or in very hot climates to warm it). If the paper is presented to the developer stage of a processor at a temperature suitable for development, the problem can be overcome.

It is known to condition photographic material using boxes full of tempered air. This is of particular use on coating tracks to enable easier spooling, for example, of the material.

SUMMARY OF THE INVENTION

It is, therefore, an object of the present invention to improved the temperature stability of the material by adjusting its temperature before processing.

In accordance with one aspect of the present invention, there is provided a method of processing photographic material comprising the steps of:

developing the material;

bleaching and/or fixing the material; and washing the material, characterized in that the material is tempered prior to the developing step to adjust the temperature of the material to the development temperature.

ADVANTAGEOUS EFFECT OF THE INVENTION

By this method, the temperature of the photographic material is adjusted to the required processing temperature before processing. The temperature of the material may be adjusted to the required temperature before or after exposure. Furthermore, the humidity of the material may also be adjusted.

BRIEF DESCRIPTION OF THE DRAWINGS

For a better understanding of the present invention, reference will now be made, by way of example only, to the accompanying drawings in which.

DETAILED DESCRIPTION OF THE INVENTION

Photographic paper from a stock roll is unwound and passed through a conditioning chamber to bring the paper up to the required processing temperature and humidity before or after exposure of the paper, but prior to processing. In most cases, the paper is heated, but sometimes it may be necessary to cool the paper prior to processing. The conditioning chamber may be the box in which the roll is kept. In this case, only temperature conditioning of the photographic paper is practically possible. Alternatively, the conditioning chamber may comprise a long box full of temperature- and humidity-controlled air or a box containing temperature-controlled rollers over which the photographic paper passes.

Figure 1:
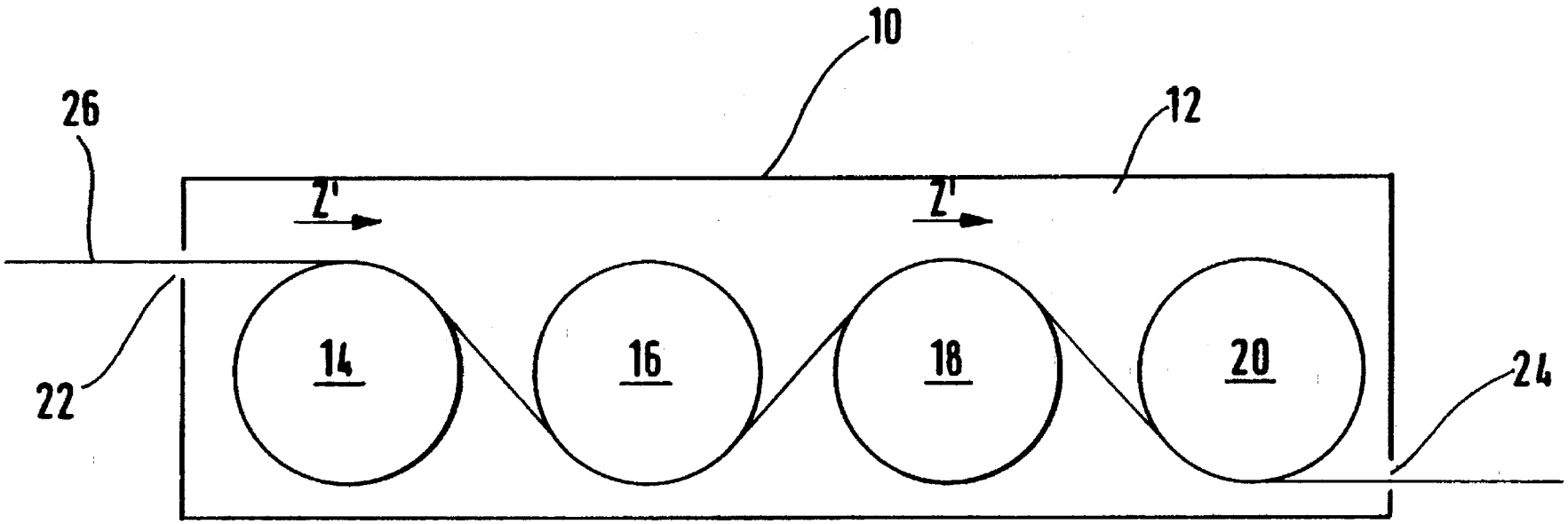
FIG. 1 is a schematic illustration of one embodiment of a conditioning chamber which can be used in the method of the present invention.

FIG. 1 illustrates a conditioning chamber 10 which comprises a box 12 in which four rollers 14, 16, 18, 20 are positioned. Box 12 may be insulated and has an inlet 22 and an outlet 24 as shown. Each roller 14, 16, 18, 20 is heated to developer processing temperature in a suitable way, for example, by induction or directly electrically or by passing hot air or water through them. Photographic paper 26 to be conditioned, shown as a solid line passing through the box 12, enters the box 12 at inlet 22 from a magazine of previously exposed paper (not shown) or from directly from an exposing device, for example, from an image setter or enlarger (not shown).

The paper 26 is driven over rollers 14, 16, 18, 20 and through the box 12, in the direction indicated by arrows 'Z', by suitable drive means (not shown). The rollers 14, 16, 18, 20 may be either free to roll or are driven at a speed which matches the transport speed of the paper 26 to assist with the transportation of the paper through the box 12. The paper 26 exits the box 12 through outlet 24 and into a processor (not shown). The box 12 is on the 'dark' side of the processor and is preferably light-tight.

As an alternative to the photographic paper 26 being exposed prior to conditioning in box 12, the paper 26 may be unexposed, passing on to an exposing device after passing through the box 12. In this case, the paper 26 is then passed on to the developer tank of a processor (not shown) whilst it is still at the correct temperature for development. This is practical if the exposing device is normally directly coupled to the processor and the conditioning chamber can be located prior to the exposing device.

Development can be carried out at a temperature in the range of 15° C. to 50° C., preferably in the range of 30° C. to 40° C., and most preferably around 35° C.

Figure 2:
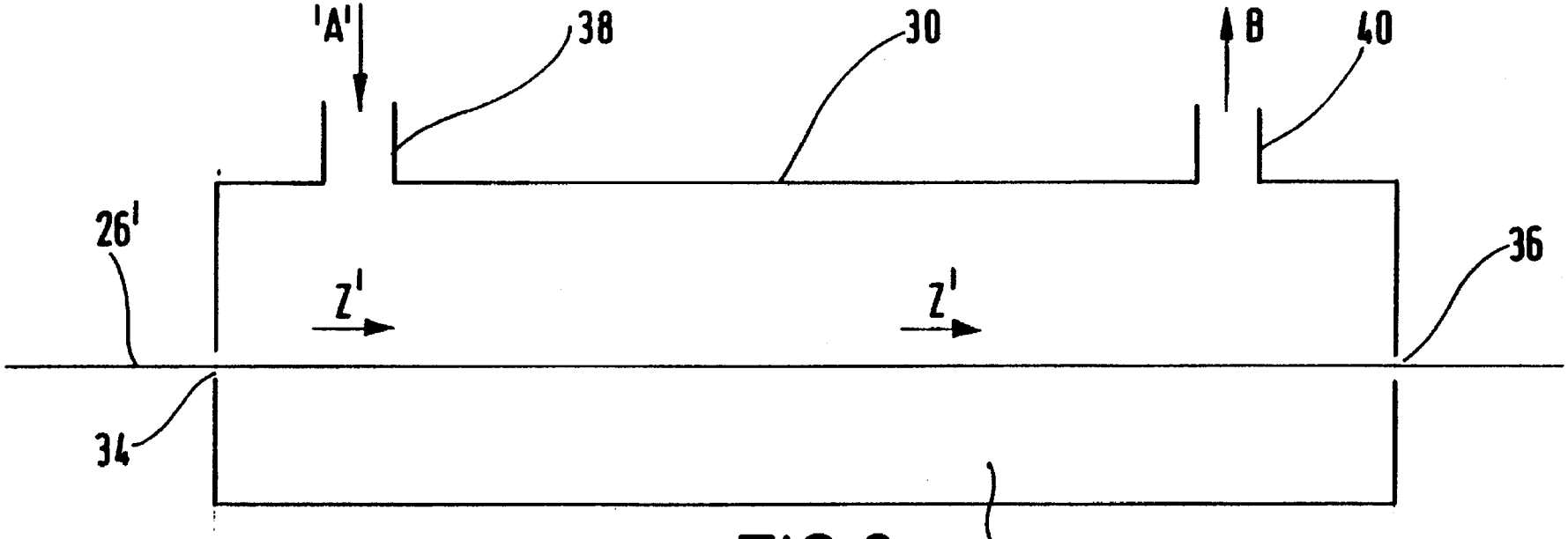
FIG. 2 is a schematic illustration of a second embodiment of a conditioning chamber for use in the method of the present invention.

In FIG. 2, the photographic paper 26 is warmed by hot air. In this case, the conditioning chamber 30 comprises a box 32 having an inlet 34 and an outlet 36. As before, the box 32 is light-tight. Tempered air is introduced into the box 32 through air inlet 38 and removed therefrom through air outlet 40 as indicated by arrows 'A' and 'B' respectively. Air inlet 38 and air outlet 40 are connected to a suitable air tempering unit (not shown).

As described with reference to FIG. 1, the paper 26 enters the box 32 through inlet 34, passes therethrough in the direction indicated by arrows 'Z', and leaves through outlet 36. As before, the now conditioned paper is passed to the development stage of a photographic processor.

The air inlet 38 and outlet 40 may be connected directly or indirectly to the dryer stage of the processor (not shown).

Figure 3:
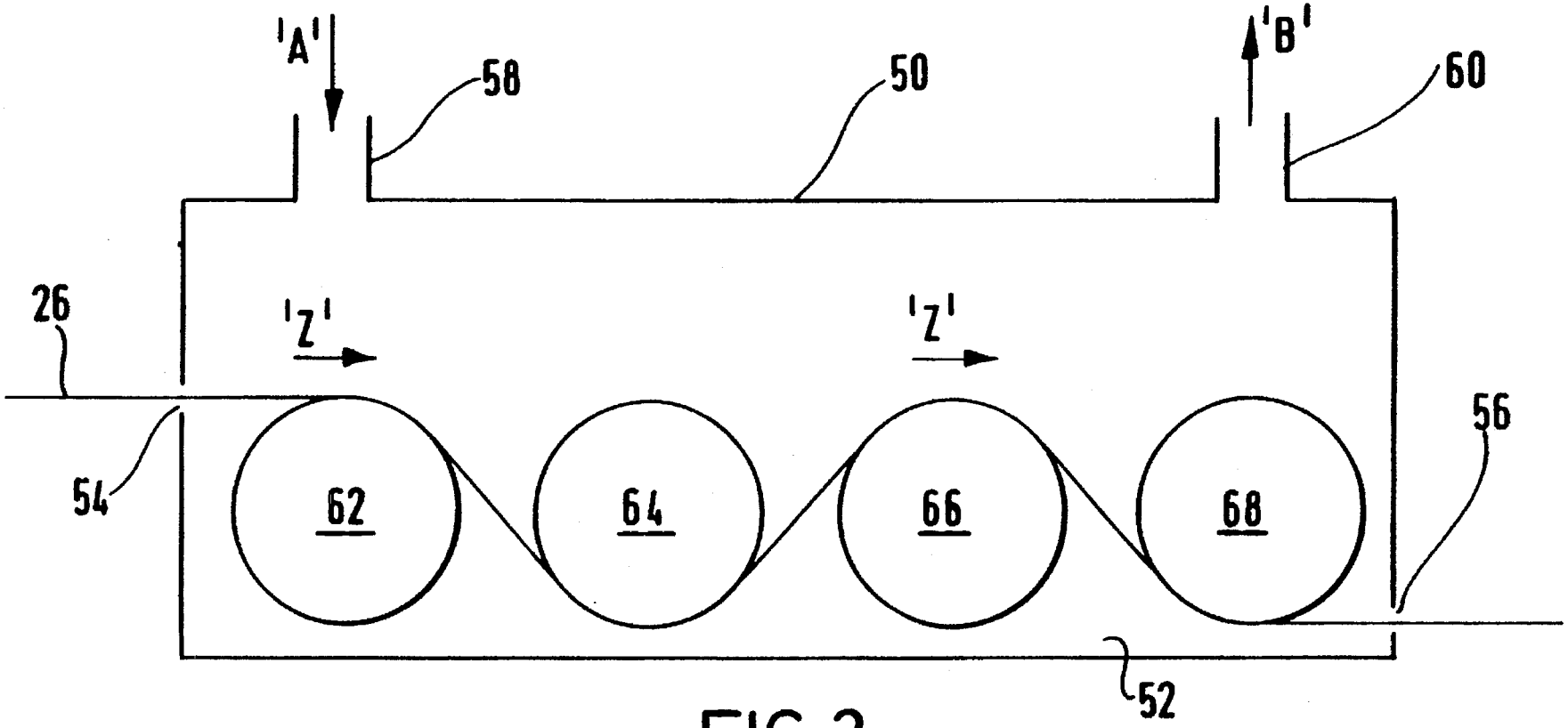
FIG. 3 is a schematic illustration of a third embodiment of a conditioning chamber for use in the method of the present invention.

FIG. 3 illustrates another conditioning chamber 50 in which tempered air is used to condition the paper 26. The conditioning chamber 50 comprises a box 52 having an inlet 54 and an outlet 56. Tempered air passes into the box 52 through air inlet 58 and is removed therefrom through air outlet 60. Paper 26 to be conditioned is driven through the box 52 over rollers 62, 64, 66, 68 in the direction indicated by arrows 'Z' as described above. In this case, rollers 62, 64, 66, 68 are not heated and provide a way of maximizing the amount of paper 26 being treated for a particular size of box.

It will be readily appreciated that the paper 26 can be conditioned by using other suitable heating means, for example radiant energy. Furthermore, the paper may be conditioned using a combination of heated rollers, radiant energy or warm air as appropriate.

Cut sheet materials may be tempered using the conditioning chambers described above if suitable transport means are provided, for example, web transport means.

It is to be noted that although the present invention has been described with reference to raising the temperature of the paper prior to processing, in some climates it may be necessary to cool the paper down to the development temperature.

Humidity control could also be included. This can be achieved by controlling the humidity of the tempered air entering the conditioning chamber.

Parts List

10 . . . conditioning chamber
12 . . . box
14, 16, 18, 20 . . . rollers
22 . . . inlet
24 . . . outlet
26 . . . paper
30 . . . conditioning chamber
32 . . . box
34 . . . inlet
36 . . . outlet
38 . . . air inlet
40 . . . air outlet
50 . . . conditioning chamber
52 . . . box
54 . . . inlet
56 . . . outlet
58 . . . air inlet
60 . . . air outlet
62, 64, 66, 68 . . . rollers

We claim:

1. A method of processing photographic material comprising the steps of:

developing the material in a developing solution;

bleaching and/or fixing the material; and washing the material, characterized in that the material is tempered in a conditioning chamber prior to entering the developing step such that the temperature of the material is adjusted to the temperature of said developing solution and passed onto the developer solution while the material is still at the correct temperature for development.

2. A method according to claim 1, wherein tempering is carried out by passing the material through a conditioning chamber in which the temperature of the material is adjusted.

3. A method according to claim 2, wherein the temperature of the material is adjusted by heated rollers positioned in the conditioning chamber and over which the material passes.

4. A method according to claim 2, wherein the temperature of the material is adjusted by tempered air passing through the conditioning chamber.

5. A method according to claim 2, wherein the temperature of the material is adjusted using radiant energy.

6. A method according to claim 1, wherein the tempering also includes adjusting the humidity of the material.

7. A method according to claim 1, wherein tempering occurs before exposure of the material.

* * * * *